United States Patent [19]

Poirier

[11] Patent Number: 4,462,191

[45] Date of Patent: Jul. 31, 1984

[54] PREFABRICATED DWELLING OF THE MODULAR TYPE

[76] Inventor: Jacques B. Poirier, Rte. 112, St-Frédéric, Quebec, Canada, G0N 1P0

[21] Appl. No.: 374,619

[22] Filed: May 3, 1982

[30] Foreign Application Priority Data

Feb. 25, 1982 [CA] Canada ..... 397084

[51] Int. Cl.[3] ..... E04H 1/00

[52] U.S. Cl. ..... 52/236.1; 52/741; 52/296; 52/223 R

[58] Field of Search ..... 52/73, 82, 236.1, DIG. 10, 52/296, 297, 79.4, 741, 223 R

[56] References Cited

U.S. PATENT DOCUMENTS

| | | | |
|---|---|---|---|
| D. 172,340 | 6/1954 | Deam | 52/236.1 |
| 3,114,176 | 12/1963 | Miller | 52/81 |
| 3,277,620 | 10/1966 | Martin | 52/82 |
| 3,543,455 | 12/1970 | Walsh | 52/236.1 |
| 3,724,142 | 4/1973 | Worthington | 52/79.4 |
| 3,727,355 | 4/1973 | Vachon | 52/82 |
| 3,733,762 | 5/1973 | Pardo | 52/236.1 |
| 3,740,903 | 6/1973 | Ahern | 52/584 |
| 3,766,932 | 10/1973 | Sidis | 52/81 |
| 4,137,679 | 2/1979 | Tully | 52/73 |
| 4,335,558 | 6/1982 | Caldwell et al. | 52/82 |

FOREIGN PATENT DOCUMENTS

| | | | |
|---|---|---|---|
| 802592 | 1/1950 | Fed. Rep. of Germany | 52/236.1 |
| 865800 | 6/1953 | Fed. Rep. of Germany | 52/236.1 |
| 1269321 | 7/1961 | France . | |

*Primary Examiner*—John E. Murtagh
*Assistant Examiner*—Kathryn Ford
*Attorney, Agent, or Firm*—Schwartz, Jeffery, Schwaab, Mack, Blumenthal & Koch

[57] ABSTRACT

A method of constructing a prefabricated dwelling on a selected lot, from at least a plurality of wall panels, symmetrical two by two with respect to a plane, each wall panel having a trapezoidal shape of which the parallel sides correspond to the vertical edges of the panel and the non parallel sides are inclined in the same direction and correspond to the upper and lower edges of the panel, and a plurality of identical roof panels between them; each roof panel having the shape of a lozenge, the wall and roof panels all having a shape-holding structural frame suitable for assembling them together in a rigid manner. According to the invention, the required foundations are provided by the selected lot itself and a base is provided to receive the wall panels directly, this base having the overall shape of the grouping of at least three regular hexagons, equal to one another and adjacent at least two by two without being in alignment. Thereafter, the required number of wall panels are mounted in symmetry alternation all about the periphery of the base and each wall panel is assembled both to the base which supports it and to two other wall panels which are adjacent thereto. Finally, the roof panels are mounted directly on the upper edges of the wall panels in a manner such that their line of slope always coincide with their small diagonal and the roof panels are assembled together in such a way as to form together a self-supporting vault resting on the wall panels.

18 Claims, 9 Drawing Figures

PREFABRICATED DWELLING OF THE MODULAR TYPE

BACKGROUND

1. Field of the Invention

The present invention relates to a prefabricated dwelling system of the modular type as well as to a method of constructing such a dwelling.

2. Prior Art

As everyone knows, there are presently existing on the market a great number of prefabricated dwellings or houses of which their structure is of the modular type. The known such prefabricated dwellings or houses are usually made from a plurality of base modules having a cubic or parallelepipedic shape which are assembled one next to the other or one above the other as the case may be. These prefabricated houses all have the advantage of being relatively economical, easy to erect and to take care of. They however all have several disadvantages which are directly connected to their structure. Among these disadvantages, one may point out for instance the necessity of requiring an almost perfect levelling off of the selected lot for their erection, another example being the monotony of their shape and appearance which does not make them very popular as an individual house or as a personal country cottage.

SUMMARY OF THE INVENTION

The present invention proposes a new system of prefabricated dwelling or house of the modular type which offers the advantages of being both economical, solid, easy to erect on any type of lot even if not levelled off and this, in a permanent manner, very easy to take care of and to heat, of a proven solidity and particularly of an altogether new look which is sufficiently attractive to interest particulars that are desirous of building a permanent house or country cottage.

More specifically, the present invention proposes a prefabricated dwelling system of the modular structure type which, because of the compact shape of the non-assembled panels that make it up and the facility with which they may be assembled, may easily be mounted, enlarged or even modified in a few hours, with or without foundations, and be transported behind a standard vehicle or by helicopter or container.

The present invention also proposes a method of constructing the particular prefabricated dwelling system of which the advantages have just been enumerated.

Thus, in accordance with the broad concept of one aspect of the invention, there is provided and claimed herein a method of constructing a prefabricated dwelling on a selected lot, from at least a plurality of wall panels, symmetrical two by two with respect to a plane; each wall panel having a trapezoidal shape of which the parallel sides correspond to the vertical edges of the panel and the non parallel sides are inclined in the same direction and correspond to the upper and the lower edges of the panel, the upper edge having a length L and an inclination angle $\alpha$, the lower edge having a length L' and an inclination angle $\alpha'$ such that $$L \cos \alpha = L' \cos \alpha',$$

a plurality of identical roof panels, each having a lozenge shape of which the sides have a length equal to L and a small angle $\beta$, such that $$\beta = \cos^{-1}\left(\frac{1 - 3\sin^2\alpha}{2}\right)$$

wherein the wall and roof panels all have a structural shape-holding frame whereby they may rigidly be assembled to one another, comprising the steps of (a) providing, on the selected site, adequate foundations and a base suitable to receive the wall panels directly on the foundations, the base having the total shape of a grouping of at least three regular hexagons equal to one another and adjacent at least two by two without all being in alignment, the hexagons having an apo them equal to:

$$\frac{1.732\, L \cos \alpha}{2}$$

(b) mounting the required number of wall panels in symmetry alternation all around the periphery of the base and assembling each wall panel both to the base which supports it and to the other two wall panels that are adjacent thereto, and (c) mounting the roof panels on the upper edges of the wall panels in such a manner that their line of slope always merge with their short diagonal, and assembling the roof panels between them in such a way that they form together a self-supporting vault bearing on the wall panels.

In accordance with the broad concept of another aspect of the invention, there is provided and claimed herein a prefabricating dwelling system comprising:

(a) foundations;

(b) a base mounted on the foundations, the said base having the total shape of a grouping of at least three equal regular hexagons adjacent at least two by two without all being in alignment, the hexagon having an apothem equal to:

$$\frac{1.732\, L \cos \alpha}{2}$$

wherein L and $\alpha$ each respectively being a predetermined length and angle;

(c) a plurality of wall panels mounted all around the periphery of the base and each assembled both to the base and to other panels adjacent thereto, the wall panels being symmetrical two by two with respect to a plane and being mounted in symmetry alternation about the base, each wall panel having a trapezoidal shape of which the parallel sides correspond to vertical edges of the panel and the non parallel sides are inclined in the same direction and correspond to upper and lower edges of the panel, the upper edge having a length equal to the predetermined length L and a small angle equal to the predetermined angle $\alpha$, the lower edge having a length equal to L' and an angle of inclination equal to $\alpha'$, wherein $$L \cos \alpha = L' \cos \alpha'$$

(d) a plurality of roof panels mounted on the upper edges of the wall panels and assembled to each other in such a manner as to form together a self-supporting vault resting on the wall panels, each roof panel having the shape of a lozenge having a side length equal to the predetermined length L and a small angle equal to $\beta$, wherein $$\beta = \cos^{-1}\left(\frac{1 - 3\sin^2\alpha}{2}\right)$$

the roof panels being mounted in such a way that their line of slope always merge with their short diagonal, (e) the wall and roof panels all having a shape-holding frame serving rigidly to assemble them to one another.

The main advantage of the prefabricated dwelling or house, according to the invention, resides in the particular form it has once assembled and which being of the dodecahedronrhombic type, has the commercial distinction of being attractive and different from the presently available forms, while being at the same time extremely solid and tough and capable of being installed on any type of lot terrain, even if it is not level.

BRIEF DESCRIPTION OF THE DRAWINGS

The invention and its various advantages will clearly come out from the description that follows of various embodiments thereof having reference to the appended drawings wherein.

DETAILED DESCRIPTION

Figure 1:
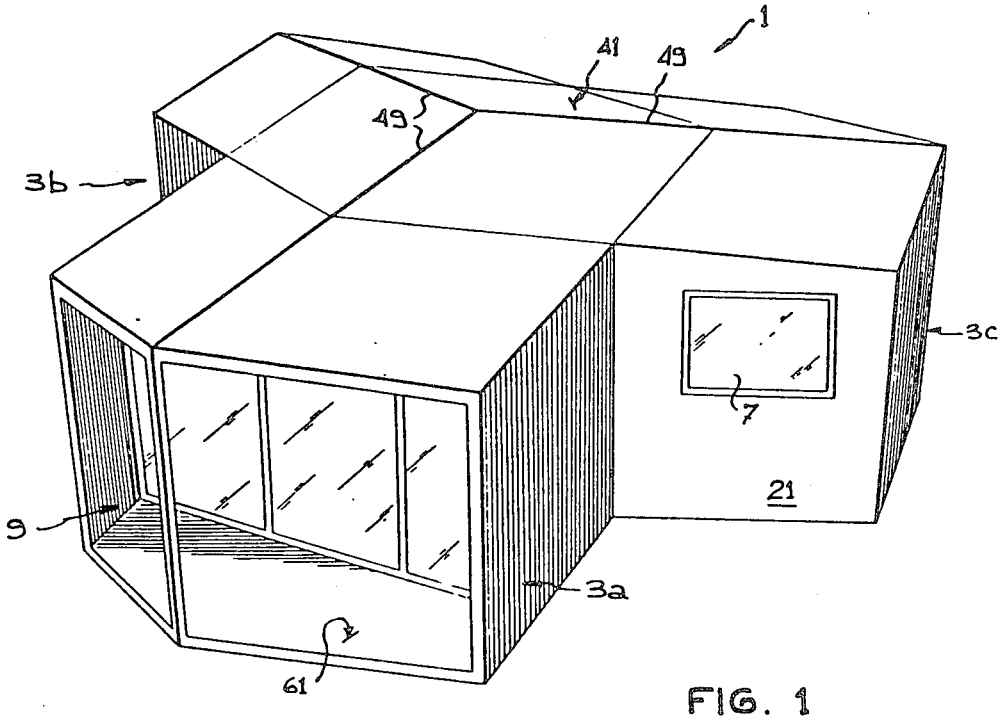
FIG. 1 is a perspective view of a first embodiment of a dwelling or house prefabricated according to the present invention.

The prefabricated house or dwelling 1, made according to the invention, illustrated generally in FIG. 1 comprises, as in any type of houses, a base 61 mounted on appropriate foundations, a plurality of outer walls 21 of which some may be provided with windows 7 and/or doors 9 and, finally, a roof 41.

The prefabricated house 1 according to the invention distinguishes however from other type of houses because, on the one hand, its base 61 has the general shape of the grouping of at least three regular hexagons defining three modules 3*a*, 3*b* and 3*c*, the said hexagons being equal to one another and adjacent at least two by two without all being in alignment and because, on the other hand, the various panels constituting the outer walls 21 are each of trapezoidal shape of which the parallel sides correspond to the vertical edges of the panel and the non-parallel sides are inclined in the same direction and correspond to the upper and lower edges of the same panel. The prefabricated dwelling 1 according to the invention also distinguishes from existing prefabricated dwellings in that its roof 4 is made up of a plurality of panels that are directly mounted on the upper edges of the wall panels and are assembled to one another in such a way as to form, together, a self-supporting vault resting on the wall panels. Each of the wall panels has the shape of a lozenge (i.e., a figure with four equal sides and two acute and two obtuse angles) and is mounted onto the others in a way such that its line of slope always merges with its small diagonal.

Figure 2:
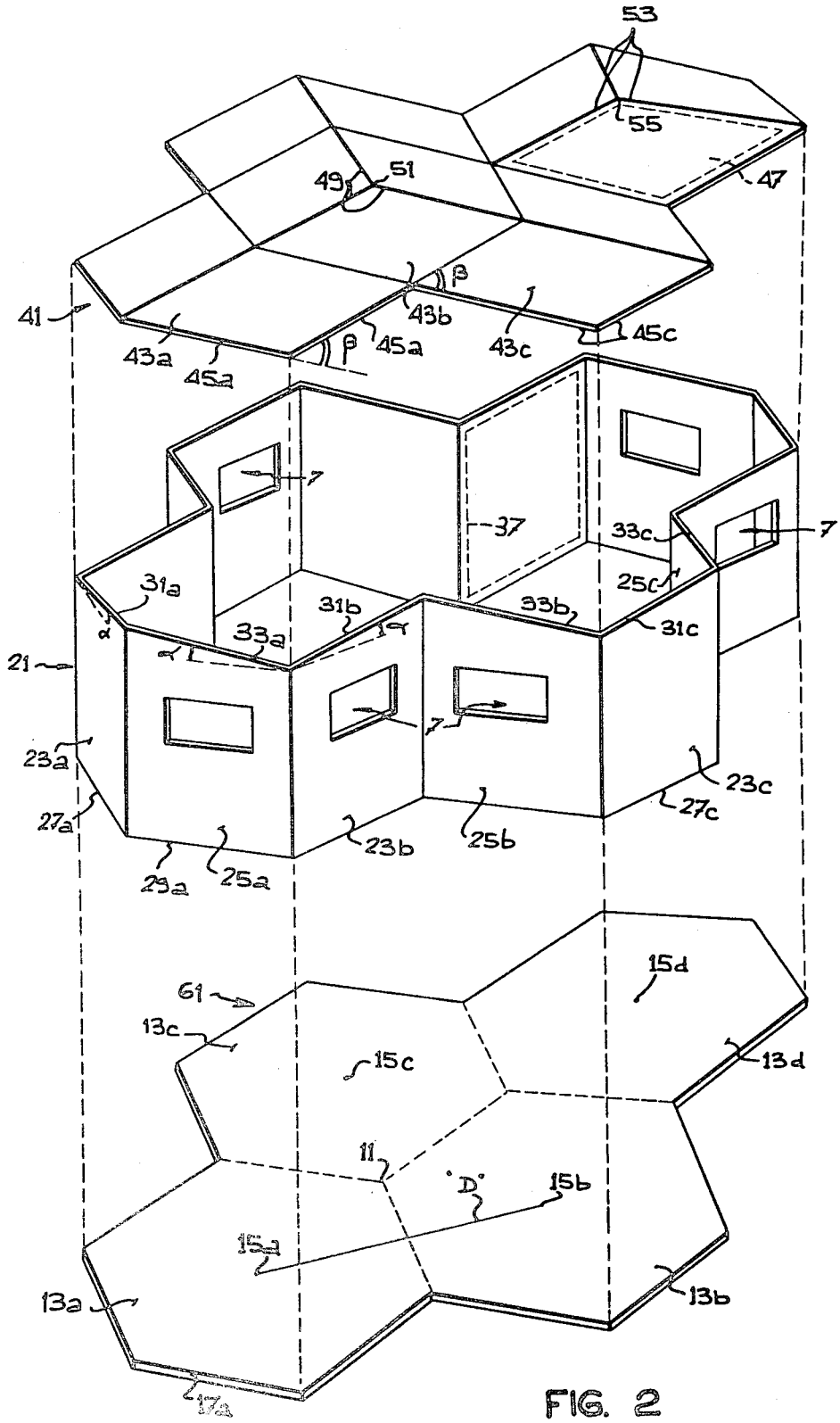
FIG. 2 is an exploded view of a further and more elaborated embodiment of a dwelling prefabricated according to the teaching of the present invention.

The first embodiment of a prefabricated house or dwelling made according to the invention, illustrated in detail in FIG. 2, is intended for mounting on a lot which has previously been levelled off and which serves as foundations. The base 61 of this dwelling is formed by a concrete slab cast on the very levelled off lot. As previously indicated, the concrete slab has the general shape of the grouping of at least three regular hexagons, four in the illustrated case, respectively numbered 13*a*, 13*b*, 13*c* and 13*d*, which are all equal to one another and are adjacent at least two by two without all being in alignment. The hexagons are so selected that the value of their common apothem be equal to:

$$\frac{1.732\ L \cos\alpha}{2}$$

L and $\alpha$ respectively having a length and an angle of predetermined value.

In accordance with the above equation determining the apothem of each hexagon, the distance D separating the centre 15*a* of the hexagon 13*a* and the center 15*b* of the hexagon 13*b* or the center 15*c* of the hexagon 13*c* is equal to:

$$1.732\ L \cos\alpha.$$

Similarly, the distance separating the center 15*b* of the hexagon 13*b* and the center 15*c* of the hexagon 13*c* or the center 15*d* of the hexagon 13*d* is equal to:

$$1.732\ L \cos\alpha.$$

The prefabricated dwelling shown in FIG. 2 also comprises outer walls 21 made up of a plurality of panels 23 and 25 mounted all around the periphery of the base. Each wall panel 23 or 25 is assembled both to the base 61 and to the other wall panels 25 or 23 which are adjacent thereto.

The wall panels 23 and 25 are symmetrical two by two with respect to a vertical plane and are mounted in symmetry alternation all around the base. Thus, the panel 23*a* is symmetrical to the panel 25*a* with respect to a vertical plane passing through the center of their adjacent vertical edges. The same applies to the panel 25*a* and the panel 23*b* which is adjacent thereto on the other side, as well as to the panel 23*b* with the panel 25*b* which is adjacent thereto, etc. all around the base. Each of the panels 23 or 25 has the general shape of a right trapezoid. The two parallel bases of this trapezoid correspond to the vertical edges of the panel; the small side 27 or 29 of the trapezoid which is perpendicular to the vertical edges correspond to the lower edge of the panel. Finally, the other small inclined side 31 or 33 of the trapezoid correspond to the upper edge of the panel.

The upper edges 31 and 33 of the panels 23 and 25 which, because of their disposition are inclined in reverse direction, have a common length equal to the length L previously determined and a small angle of inclination $\alpha$ equal to the aforegiven angle $\alpha$.

As to the lower edges 27 and 29, they have a length equal to L', this length L' itself being equal to the common length of each of the sides 17 of the different hexagons 13 defining the base. If the length of the apothem of each of the hexagons of the dwelling model illustrated in FIG. 2 is equal to $$\frac{1.732\, L \cos \alpha}{2}$$

as previously indicated, the length L' is equal to L cos $\alpha$.

As mentioned above, the panels 23 or 25 may be prefabricated with a door 9, a window 7 or both.

Each panel 23 or 25 has a shape-holding structural frame 37 shown in broken lines in FIG. 2. This structural frame 37 may be made out of steel or out of any other material that will provide each of the panels with sufficient stiffness. The corners of each frame 37 may be provided with securing means to fix each panel not only to the base 61 but likewise to the wall panels 23 or 25 which are adjacent thereto and to the roof 41. These securing means, not shown, may be constituted by securing lugs integrally extending each corner of the frame 37 in such a manner as to cooperate with the securing lugs of the frames of adjacent panels and be rigidly connected thereto by bolt means. Each panel may of course be thermally insulated and built to allow for electric wiring, piping or any other element that is necessary for the completion of the dwelling or house.

Finally, the prefabricated dwelling illustrated in FIG. 2 comprises a plurality of roof panels 43 directly mounted on the upper edges 31 and 33 of the wall panels 23 and 25. These roof panels each comprise a stiff structural frame 47 of which the ends are provided with securing lugs such as those that have been previously mentioned with respect to the wall panels. These securing lugs allow the various roof panels 23 to be secured to one another as well as to the upper edges 31 and 33 of the wall panels 23 and 25 to form together a self-supporting vault resting on the wall panels.

As with the wall panels 23 and 25, the roof panels 43 are identical whereby to reduce to a minimum the number of different structural elements of the dwelling and each has the form of a lozenge having a side length equal to the length L of the upper edges 31 and 33. Each lozenge also has a small angle equal to $\beta$, wherein $$\beta = \cos.^{-1}\left(\frac{1 - 3\sin^2 \alpha}{2}.\right)$$

The rhombic shape of these roof panels and the selection of the length L for their side 45 and of the small angle $\beta$ advantageously allow them to be directly mounted on the upper edges 31 and 33 of the wall panels.

In practice, the roof panels are first assembled on the upper edges 31 and 33 of the wall panels 23 and 25, then between themselves, in a manner such that their line of slope always be continuous with their small diagonal, i.e., the distance between the two obtuse angles. The particular selection of the length of the side and of the small angle of these roof panels 43 result in that they together define three horizontal ridge lines 49 intersecting at a central point 51, located precisely above the geometric center 11 of three of the hexagons 13*a*, 13*b* and 13*c* of the base 61, adjacent two by two.

As can easily be observed from a study of FIGS. 1 and 2, nine roof panels 43 are necessary to cover the surface defined by the three hexagons 13*a*, 13*b* and 13*c* of the base 61. A study of FIG. 2 likewise shows that three panels 43 are necessary to cover the surface of the fourth hexagon 13*d* of the base. These three additional roof panels together form a cupola or dome having three edges 53 and a central elevated point 55 located just above the center 15*d* of the fourth hexagon 13*d* of the base 61.

It will thus be gathered that the roof 41 contains three panels 43 per hexagon 13 defined in the base 61. These panels could all be arranged as a cupola such as the one above the hexagon 13*d*. However, this arrangement could in certain cases, having respect to the arrangement of the hexagons of the base 61, result in the formation of a basin at the center of the roof in which rain water or snow would accumulate and eventually cause leaks.

Consequently, the arrangement of the roof panels such as that illustrated in FIG. 1 results in the formation of ridge lines 49 extending horizontally away from and about a central point 51 located above the geometric center 11 of three of the four hexagons of the base 61. Apart from the advantage previously mentioned, this arrangement also has the additional advantage of giving the dwelling an extremely pleasant esthetic appearance which can easily be observed from FIG. 1.

Obviously, the section of the structure for the frames 37 and 47 of the wall and roof panels is made so that they can all resist the loads to which they are expected to be subjected. More specifically, the frame 37 of the wall panels must be able to support the weight of the roof 41 and capable of resisting the lateral loads created by the vault of the roof. Similarly, the frame 47 of the roof panels must be able to resist the compression forces extending along their diagonal, the compression forces extending along their sides as well as the bending stresses applied at their center. Furthermore, due to the particular arrangement of the assembly, structural <<valleys>> are formed when the base has more than three hexagons, which <<valleys>> advantageously reinforce all of the vault 41 as do, besides, the ridges 49.

In practice, the heart of each of the wall panels 43 which defines the structural frame 47 is selected so that its structure be sufficient to resist service charges such as, for instance, lifting forces due to the wind or the weight of the snow and obviously also all of the dead loads.

As has previous been indicated, the roof 41 does not have any girders nor joists. This self-supporting roof 41 defines a vault which, along its perimeter, is held captive within the steel belt defined by the upper edges of the wall panels 23 and 25. In order to reinforce the joints between the roof panels 43, steel beams interconnected by welded steel plates then bolted at the site may be used to ensure that the compression stresses developed in the loaded oblique ribs be converted into vertical loads absorbed by the wall panels themselves.

The roof panels of course have the function of supporting the load which they develop inside the steel shapes. In order to improve this function, the edges of each panel 43 are secured and consolidated over the top of the wall panels or over the adjacent roof panels by injection, under pressure, of a stable polyurethane offering a good resistance to crushing. Further to its sealing property, this polyurethane joint holds the joints straight and true, thereby increasing by a factor of at least 1.3 the resistance capacity of the structural assembly beyond the snow loads provided in the North American building code.

In fact, the care brought in the making of these joints is related not only to structural reasons but also to practical reasons, since it is obvious that a prefabricated dwelling or house is fit for occupation once assemblied only if it is truly water and airtight. It thus results that after having structurally joined the frames of the wall panels to the base 61 and after having structurally joined the roof panels both together and to the wall panels, the cracks at the joints are injected with polyurethane spread from pressure cans or the like. Thereafter, a rolled aluminum section may be applied on a mastic compound then finally a finishing molding may be slid from top to bottom in the hook member. Due to the high sealing degree thus achieved, the dwelling prefabricated according to the invention may advantageously be equipped with a passive or active solar heating system.

The assembly made up of the hexagon 13*d* of the base, the peripheral walls of the said hexagon and the portion of the roof corresponding thereto together form a modular addition to the base structure defined by the three hexagons 13*a*, 13*b* and 13*c* of the base 61 as well as by the walls and roof of the said unit. In fact, this modular addition as well as any other addition that may be brought thereafter will have, in relation to its position and its function, a base and walls which are directly associated with the base and the walls of the main unit of the dwelling. However, the roof of this modular unit has a structure which is autonomous with respect to the roof structure of the base unit.

In principle, the above-described dwelling or house is assembled by first proceeding with levelling off of the selected lot, by casting the base 61 over the lot, by securing the structural wall panels 21 to this base as well as together and finally by mounting the various panels that constitute the roof 41 directly over the upper edges of the roof panels. Once this structure is mounted, the joints that are necessary to provide sealing of the house are made.

The slab 61 being cast directly over the ground and being consequently planar, no floor is necessary. However, in most cases, such a floor will nevertheless be provided at a certain distance from the upper surface of the slab 61 to better insulate the living space of the dwelling.

In the embodiment of the invention which has just been described, the dwelling rested directly on the ground.

In accordance with another embodiment of the invention illustrated in FIGS. 3 to 7 of the appended drawing, the house prefabricated according to the invention rests on a pile system and is extremely interesting inasmuch as it allows the dwelling prefabricated according to the invention to be installed on any lot even if it is not levelled off.

Figure 7:
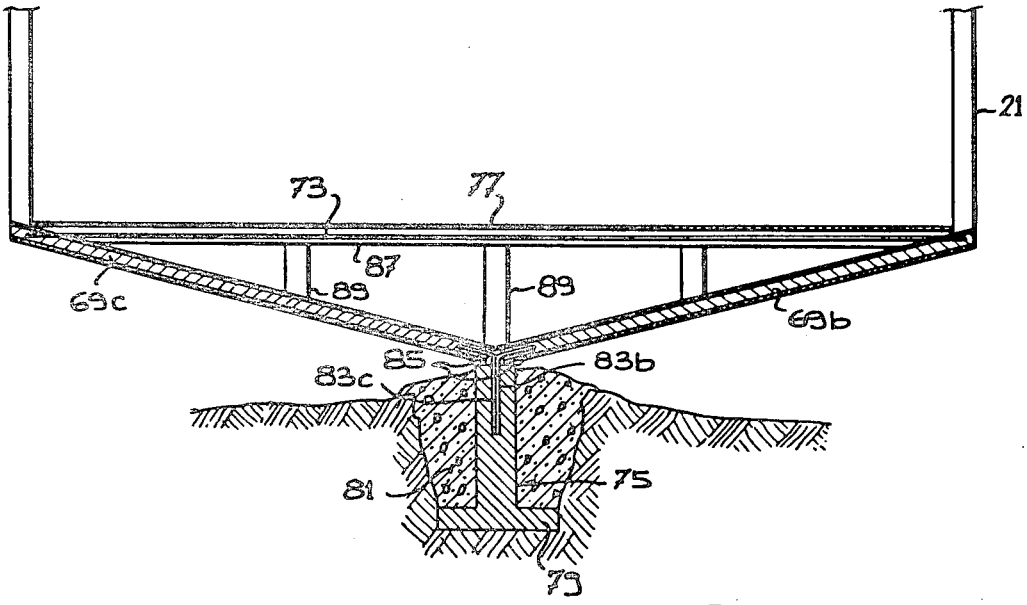
FIG. 7 is an enlarged cross-sectional view particularly intended to illustrate the foundation system used in the prefabricated dwelling embodiment shown in FIG. 3.

According to this other embodiment of the invention, the prefabricated dwelling rests on foundations that are made up of at least three bearing points 75 provided respctively at the center of at least three regular hexagons, of equal size, adjacent at least two by two without all being in alignment and of which the grouping constitutes the base of the house. These bearing points 75 may advantageously be concrete piles cast into holes 81 provided for this purpose in the ground and at the upper end of each of which three armature bars 83*a*, 83*b* and 83*c* extend, being bent out according to angles such as are illustrated in FIG. 7.

The length of each of these piles 75 of course depends on the nature of the lot over which the house is to be built. If the ground of the lot is granite rock, the pile 75 may be cast directly in a previously made hole. If the ground of the lot is softer, each pile 75 may be prefabricated to the desired height and then provided at its lower end with a footing 79 to increase the bearing surface of the portion of the dwelling load transmitted to the upper end of the pile 75.

As previously indicated, the piles 75 are disposed respectively at the center of regular hexagons. As is the case with the previously described dwelling shown in FIG. 2, the size of each of these hexagons, from above, is selected so that their apothem be equal to 1.732 L cos $\alpha$, L being respectively the length of the upper edge of the wall panels and $\alpha$ the small angle formed by the upper edge of each of the wall panels with the horizontal.

The base, properly speaking, of the house which, as seen from above, has the general shape of a grouping of at least three regular hexagons equal to one another and adjacent at least two by two without all being in alignment with an apothem equal to $$\frac{1.732\ L \cos \alpha}{2},$$

is itself made up of a plurality of base panels 63*a*, 63*b*, 63*c*, etc . . . , mounted three by three about a central point 71 corresponding to the top of the piles acting as the bearing point 75. These base panels 63 are all identical among themselves and all have the shape of a lozenge of which the length of one side and the small angle are respectively equal to L' and $\beta'$, L' being the length of the lower edge 27 or 29 of the wall panels 23 or 25 of the house, $\beta'$ being itself equal to:

$$\frac{\mathrm{Cos}^{-1}(1 - 3 \sin^2 \alpha')}{2},$$

$\alpha'$ being the small angle formed by the lower edge 27 or 29 of the wall panels 23 and 25 with a horizontal line or plane.

Because the vertical edges of the wall panels are parallel, the numerical values of the length L' and of the angle $\alpha'$ are of course directly connected to the values of the length L and of the angle $\alpha$ in the equation:

$$L \cos \alpha = L' \cos \alpha'.$$

In this respect, it may be mentioned that in a particular variant of the invention, L is selected in such a way as to be equal to L' and $\alpha$ selected to be equal to $\alpha'$. Each wall panel thus has the shape of a perfect parallelogram; $\alpha$ being equal to $\alpha'$, $\beta$ is consequently equal to $\beta'$. The result is thus that the shape and the dimension of the roof panels 43 and of the base panels 63 are absolutely identical.

Each base panel 63 has, similarly to the wall and roof panels of the house according to the invention, a structural shape-holding frame 67 provided with securing lugs for its assembly to the base panels which are adjacent thereto and to the lower edges of the wall panels 23 or 25, as the case may be. Contrary however to the wall and roof panels which have only this structural frame, the base panels each further has reinforcing bar 69 which spread along the full length of their small diagonal to allow this small diagonal to support a compression load.

The base panels 63 are mounted three by three around each bearing point 75 in such a manner that their small diagonals converged toward this bearing point. They are assembled to one another in such a way that the base assembly made up of these panels bears only on the bearing points 75 to which they entirely transmit the load of the house via their reinforcing bars 69. To ensure the transmission of this load which, because of the structure of the house and of the wall panels is applied only along the outer periphery of the base, the reinforcing bars 69*a*, 69*b* and 69*c* of the three panels 63*a*, 63*b* and 63*c* mounted about each bearing point 75 are preferably connected together and are each directly connected to the armature rods 83*a*, 83*b* and 83*c* of the piles.

Figure 3:
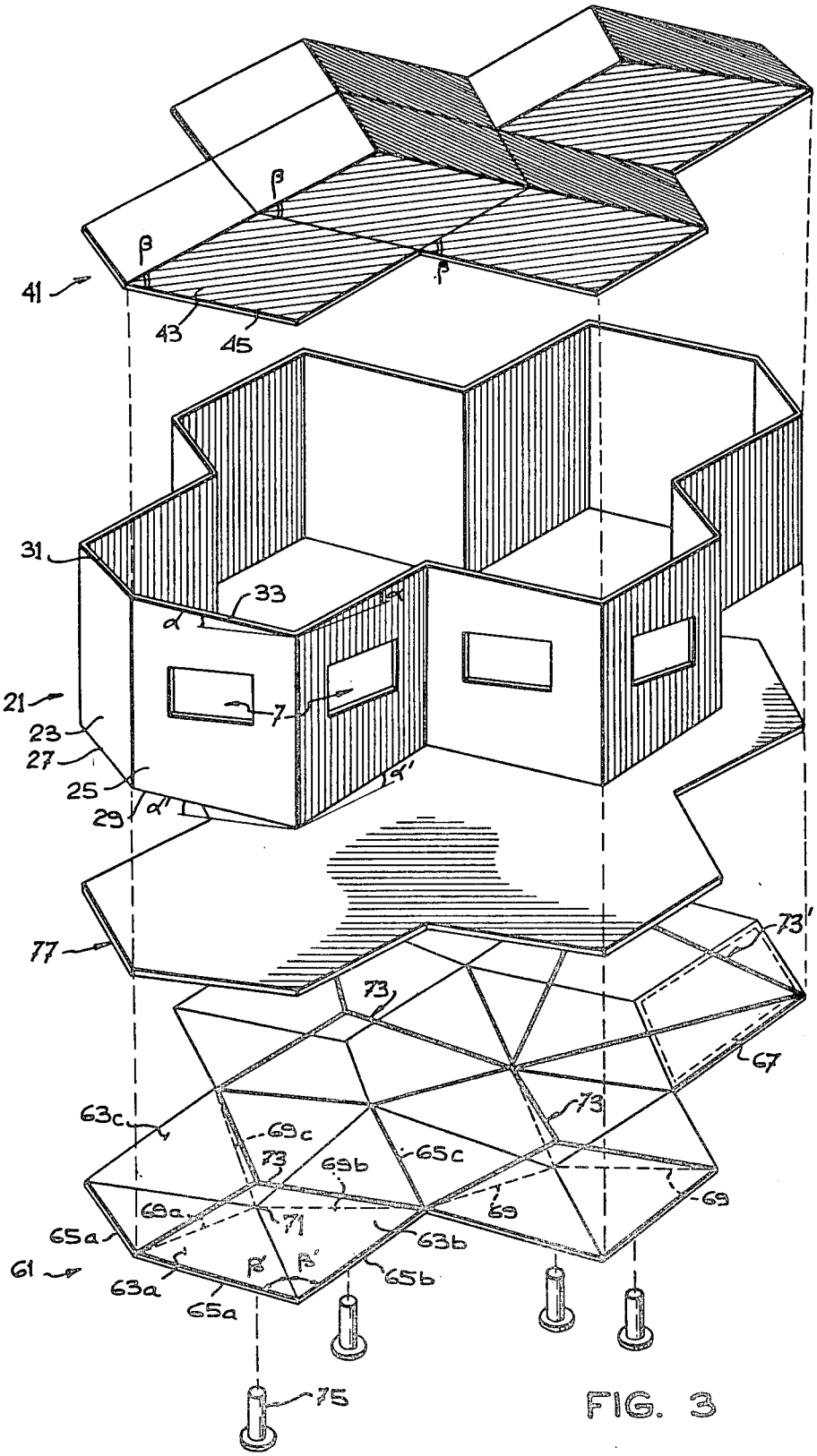
FIG. 3 is an exploded perspective view of a variation of the embodiment shown in FIG. 2.
Figure 4:
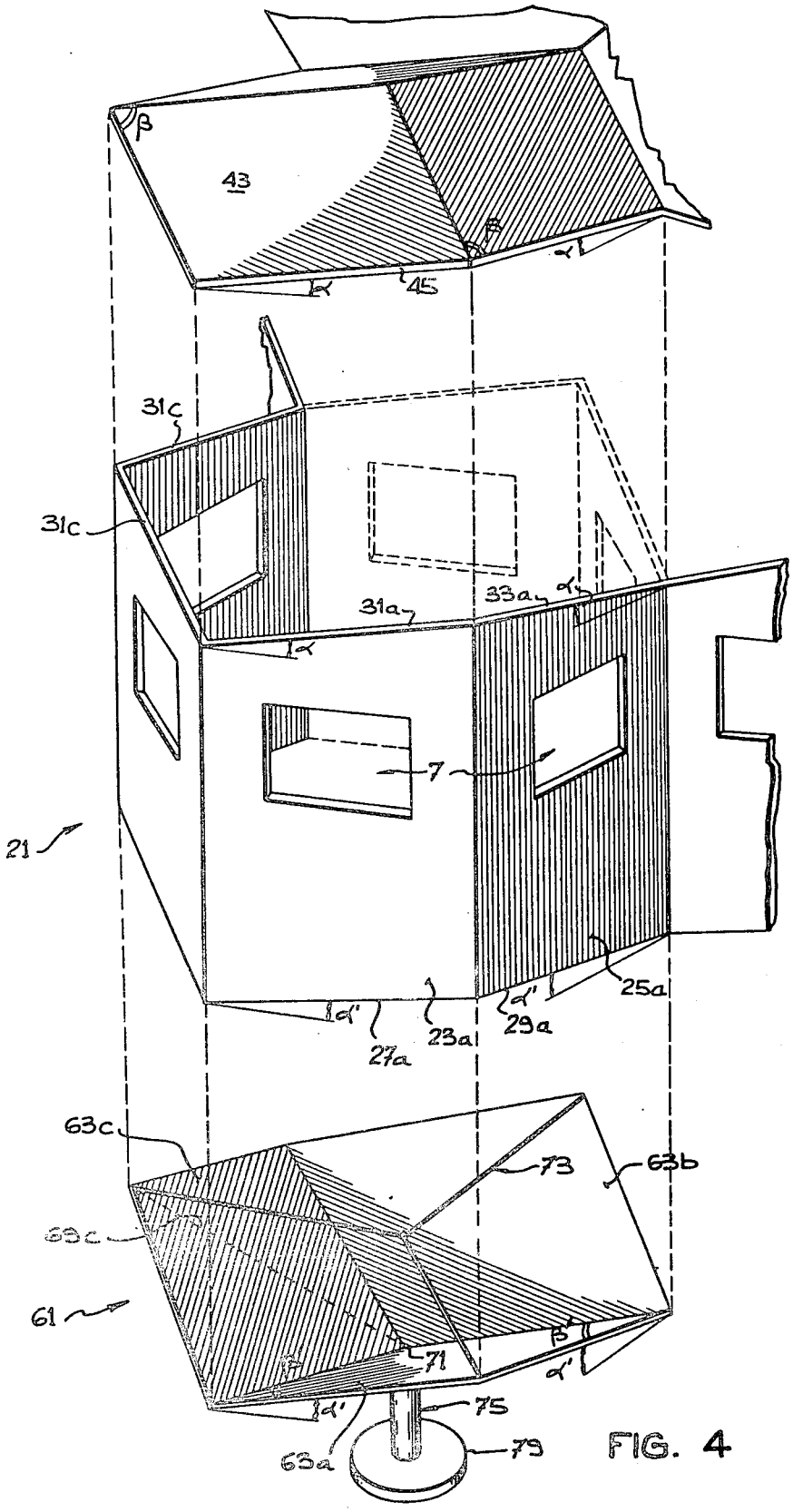
FIG. 4 is an enlarged exploded perspective view of one of the base modules of the dwelling embodiment illustrated in FIG. 3.

In practice, the mere reinforcing bars working in compression would not be sufficient to provide self-bearing of the house. To ensure the latter, it is necessary to use tension elements to join them together and hold the free ends of the reinforcement bars of the three base panels 63*a*, 63*b*, 63*c*, mounted around their common bearing point 75. As illustrated in FIG. 3, these tension elements 73 or 73' may have the shape of a Y or that of a Δ and be formed by steel rods bolted at the ends of the reinforcement bars 69. If need be, these rods may be provided with clamping means allowing them to be adjusted (tightened or loosened) at will directly at the site during assembly of the house.

Once the piles 75 are driven or cast at the site and the base panels are mounted on the piles and assembled together, the wall panels 23 and 25 as well as the roof panels 43 may be mounted directly on the respective peripheral belt of the base and of the roof in the same manner as that previously explained with respect to the house model illustrated in FIG. 2 in following exactly the same steps. Because of the particular selection of lengths L and L', and angles $\alpha$, $\alpha'$, $\beta$ and $\beta'$, previously determined, the prefabricated house once assembled has the general form of an assembly of rhombic dodecahedrons adjacent one another and which, in the particular case where L is equal to L', $\alpha$ is equal to $\alpha'$, may be a perfect or quasiperfect from depending on the height selected for the wall panels.

The construction of the roof 41 of the house model illustrated in FIG. 3 is of course absolutely identical to the roof 41 of the house model illustrated in FIG. 2. Indeed, the latter is in principle only a particular variant of the house illustrated in FIG. 3 for which the angle $\alpha'$ is equal to 0. The roof 41 as well as its various features are again illustrated in plan view in FIG. 5.

However, contrary to the house model illustrated in FIG. 2, that shown in FIG. 3 necessarily infers the presence of a floor 77 mounted over the tension elements 73 or 73'.

In order to obtain the stability that such a floor 77 requires, at least one master beam 87 is mounted directly on the base 61, there being one master beam 87 for each hexagon of the base. Advantageously, the beams 87 are mounted on posts 89 in such a way as to transmit their load either directly to the upper ends of the bearing points 75 or to the reinforcing bars 69 that work in compression (FIG. 7). In turn, the master beams may serve to support joists over which the floor 77, made up of plywood boards or floor boards, may be mounted.

Figure 9:
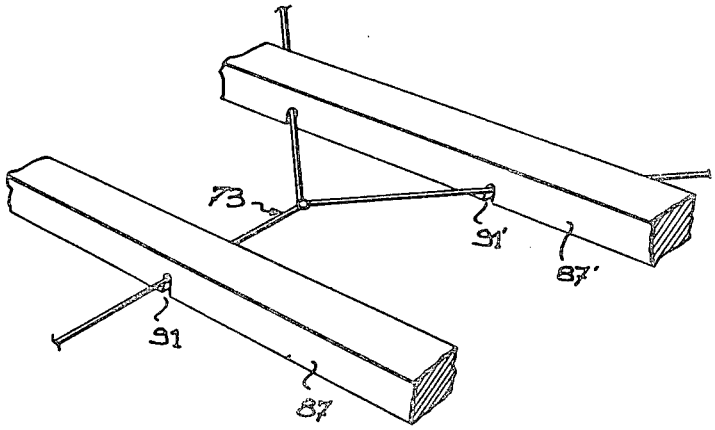

In order to reduce vibrations to a maximum, the master beams 87 (not shown) 87' (FIG. 9) may advantageously be mounted in such a way as to straddle the tension elements 73 or 73'. This straddling may be achieved by having the branches of the tension elements 73 or 73' extend across appropriate slots 91 and 91', previously provided in the master beams 87 or joists 87'.

As can be understood, any vibration of the elements 73 or 73' will automatically be absorbed by the wood. Similarly, any vibration or floor stresses will be transmitted and absorbed in the vertical direction by the tension elements 73 which, by their position, come to straddle or reinforce the seating of the floor.

Figure 6:
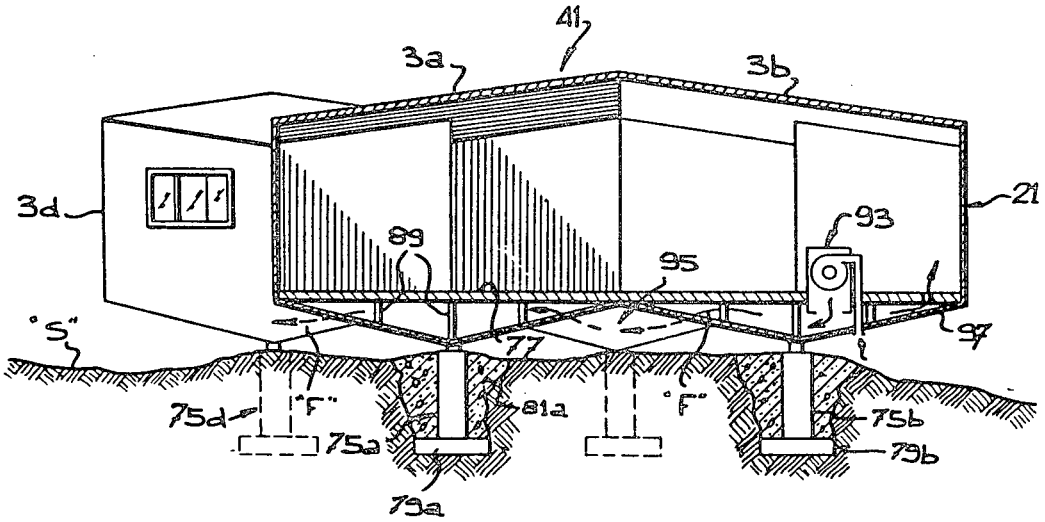
FIG. 6 is a side elevation view, partly in cross-section, of the dwelling embodiment illustrated in FIG. 3.
Figure 5:
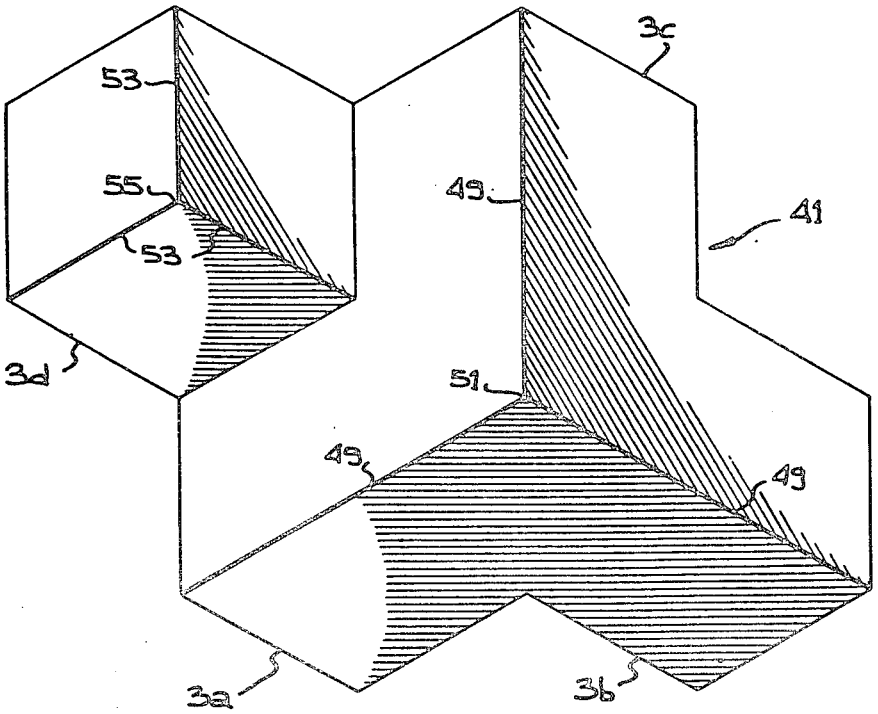
FIG. 5 is a top plan view of the prefabricated dwelling embodiments illustrated in FIGS. 2 and 3.

The structure of the base 61 of the model of the houses illustrated in FIGS. 3 to 7 has the advantage of automatically providing a plurality of spaces that communicate one with the other beneath each floor portion corresponding to one of the hexagons of which the grouping defines, seen from above, the base of the house. This space makes it of course possible thermally to insolate the floor. By providing approriate traps, this space may likewise serve to provide the users of the house with a storing area of easy access. Finally, these spaces which, as previously indicated, intercommunicate due to the particular structure of the base 61, may serve as air admission and return means for a hot air heating system 93, as illustrated in FIG. 6. According to this arrangement, the blower of the heating system 93 draws cool air from the floor, heats it and blows it inside the overall space 95 provided between the floor 77 and the base 61. The thus blown hot air spreads out beneath the whole floor and heats it, is then brought up to the aeration openings 97 provided beneath each of the windows 7 of the house. The main advantage of this structure is that it avoids the installation of air conduits as is presently the case in any type of houses, whether they be prefabricated or not. In fact, the heat openings 97 may simply be holes or apertures eventually provided with a grill.

Obviously, once the house has been assembled and its floor made, the inside of the house must then be fitted but this fitting is however carried out in a completely traditional manner which will not be described in detail herein.

Figure 8:
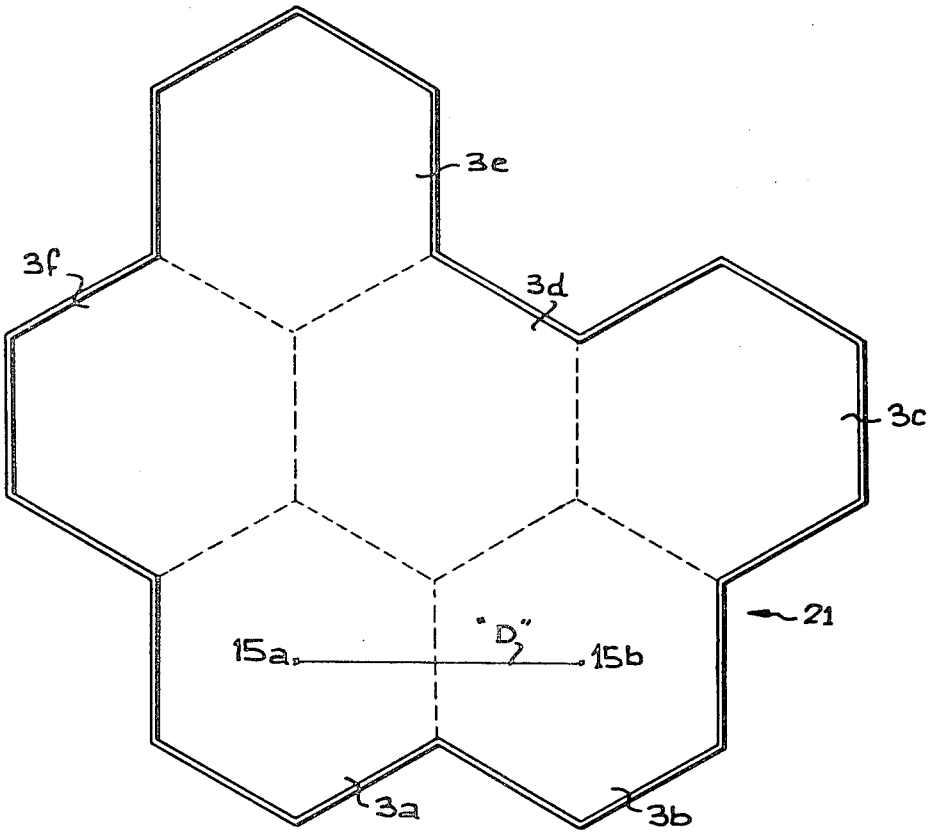
FIG. 8 is a top plan view of a further embodiment of a prefabricated dwelling or house made according to the present invention, intended to illustrate the multiplicity of possible shapes, and FIG. 9, appearing on the same sheet of drawing as FIG. 1, is a partial perspective view, on an enlarged scale, of the assembly of beams used to support the floor of a prefabricated dwelling embodiment such as that illustrated in FIG. 3.

One of the main advantages of the dwelling prefabricated according to the teaching of the present invention resides in its structure of modular type which makes it possible, whenever necessary, to quickly assemble an additional hexagonal module by mere provision of an additional pile 75, removal of two wall panels and assembling of the additional module directly to the already built house. A possible embodiment of this nature is illustrated in FIG. 8. As will be gathered, this embodiment comprises a base unit constituted by three hexagonal elements 3a, 3b and 3d to which three other elements 3c, 3e and 3f have been hooked. In fact, the possibility of enlarging a house or dwelling prefabricated according to the present invention are unlimited, the only precaution being to avoid the formation of hollows or basins on the roof 41 unless roof drains have been provided.

I claim:

1. Method of constructing a prefabricated dwelling on a selected lot, from at least a plurality of wall panels, symmetrical two by two with respect to a plane; each wall panel having an upper edge, a lower edge and a pair of vertical edges; each panel further having a trapezoidal shape of which parallel sides correspond to the vertical edges of the panel and at least one non parallel side is inclined relative to the parallel sides and corresponds to the upper edge of the panel, the upper edge having a length L and an inclination angle $\alpha$, the lower edge having a length L' and an inclination angle $\alpha$, such that $$L \cos \alpha = L' \cos \alpha',$$

a plurality of identical roof panels, each having a lozenge shape having a long diagonal and a short diagonal of which the sides have a length equal to L and an acute angle $\beta$, such that $$\beta = \cos^{-1}\left(\frac{1 - 3 \sin^2\alpha}{2}\right)$$

wherein the wall and roof panels all have a structural shape-holding, four cornered frame whereby they may rigidly be assembled to one another, comprising the steps of (a) providing, on the selected site, adequate foundations and a base suitable to receive the wall panels directly on the foundations, the base having the total shape of a grouping of at least three regular hexagons equal to one another and adjacent at least two by two without all being in alignment, the hexagons having an apothem equal to:

$$\frac{1.732\, L \cos \alpha}{2}$$

(b) mounting the required number of wall panels in symmetry alternation all around the periphery of the base and assembling each wall panel both to the base which supports it and to the other two wall panels that are adjacent thereto, and wherein the upper edge of adjacent wall panels alternately slope at at angle $\alpha$ downwardly and at an angle $\alpha$ upwardly, and (c) mounting the roof panels on the upper edges of the wall panels in such a manner that their line of slope always merge with their short diagonal, and assembling the roof panels between them in such a way that they form together a self-supporting vault bearing on the wall panels.

2. A method as claimed in claim 1, further comprising:

levelling off the selected site to provide the said foundations;

casting a concrete slab over the levelled site to provide the said base, and selecting the length L' of the bottom edges of the wall panels so as to be equal to L cos $\alpha$ by having the angle $\alpha'$ of inclination of the said lower edges equal to 0 whereby the wall panels may be made to rest flatly on the base.

3. A method according to claim 1, further comprising:

making the foundations on the selected lot to constitute at least three bearing points located respectively at the center of one of the regular hexagons of which the grouping constitutes the base of the dwelling;

mounting three base panels about each of the bearing points and assembling each base panel to all other base panels adjacent thereto, whether they be or not arranged about the same bearing point, the base panels being identical and having a lozenge shape of which a length of a side and an acute angle $\beta'$ are respectively equal to L' to $\beta'$, wherein:

$$\beta' = \cos^{-1}\left(\frac{1 - 3 \sin^2 \alpha'}{2}\right),$$

each base panel having a structural shape-holding, four cornered frame, useful for assembly, and a reinforcing bar having free ends and extending the full length of the short diagonal thereof to allow said bar to absorb a compression load; the base panels each being mounted about one of the bearing points in a manner such that its short diagonal converges toward the one bearing point, the base panels being then assembled so that they all rest solely on the bearing points thereby transferring thereto all loads borne by the reinforcing bars;

reinforcing the thus made base by joining together the free ends of the reinforcing bars of the three base panels, arranged about each bearing point, to a tension element having a Y or a $\Delta$ shape, and mounting a floor over the base after completion of the dwelling.

4. A method as claimed in claim 3, wherein the length L and L' and the angles $\alpha$ and $\alpha'$ of inclination of the upper and lower edges of each wall panel are respectively equal so that the roof panels and the base panels have exactly the same shape and size.

5. A method as claimed in claim 2, 3 or 4, further comprising pre-forming at least one wall panel with at least one opening therein.

6. A method as claimed in claim 3 or 4, further comprising reinforcing the assembly of roof panels lying in a common plane by bolting a shape along the full length of their common edges.

7. A method as claimed in claim 3 or 4, further comprising providing each bearing point by casting a concrete pile in the ground, said pile having an upper end of which project three armature rods that are folded so as to respectively engage the reinforcing bars of the base panels assembled on the said bearing point.

8. A method as claimed in claim 3 or 4, further comprising assembling the base, wall and roof panels together solely by bolting the corners of their respective structural frame.

9. A method as claimed in claim 3, further comprising mounting the floor by fixing at least one master beam passing by and resting on at least one bearing point, mounting joists on and straddling the Y-shaped tension members to absorb any vibration thereof, and mounting the floor over the joists.

10. A prefabricating dwelling system comprising:

(a) foundations;

(b) a base mounted on the foundations, said base having the total shape of a grouping of at least three equal regular hexagons adjacent at least two by two without all being in alignment, the hexagon having an apothem equal to:

$$\frac{1.732\,L\cos\alpha}{2}$$

wherein L and $\alpha$ each respectively being a predetermined length and angle, $\alpha$ being greater or less than 0°;

(c) a plurality of wall panels mounted all around the periphery of the base and each assembled both to the base and to other panels adjacent thereto, the wall panels being symmetrical two by two with respect to a plane and being mounted in symmetry alternation about the base, each wall panel having an upper edge, a lower edge and a pair of vertical edge, each wall panel further having a trapezoidal shape of which parallel sides correspond to vertical edges of the panel and at least one non parallel side is inclined relative to the parallel sides and corresponds to the upper edge of the panel, the upper edge having a length equal to the predetermined length L and an acute angle equal to a predetermined angle $\alpha$, the lower edge having a length equal to L' and an angle of inclination equal to $\alpha'$, wherein $$L\cos\alpha = L'\cos\alpha'$$

(d) a plurality of roof panels mounted on the upper edges of the wall panels and assembled to each other in such a manner as to form together a self-supporting vault resting on the wall panels, each roof panel having the shape of a lozenge having a side length equal to the predetermined length L and a small angle equal to $\beta$, wherein $$\beta = \cos^{-1}\left(\frac{1-3\sin^2\alpha}{2}\right)$$

the roof panels being mounted in such a way that their line of slope always merge with their short diagonal, (e) the wall and roof panels all having a shape-holding, four cornered frame serving rigidly to assemble them to one another.

11. A system according to claim 10, wherein:

(a) the foundations are constituted by a lot surface that has been levelled off;

(b) the base is a concrete slab cast over the levelled off lot, and (c) the wall panels are made in such a way that the length L' of their lower edges is equal to L cos $\alpha$ by having the angle $\alpha'$ of the lower edges equal to 0 whereby the wall panels may be made to rest flatly on the base.

12. A system according to claim 10, wherein:

(a) the foundations are constituted by at least three bearing points located respectively at the center of one of the regular hexagons of which the grouping define the overall shape of the base of the dwelling, (b) the base of the dwelling is made up of a plurality of base panels mounted three by three about each bearing pont and assembled to one another whether they be or not disposed about the same bearing point, the base panels all being identical and all having a lozenge shape of which a length of a side and an acute angle are respectively equal to L' and $\beta'$, the latter itself being equal to:

$$\cos^{-1}\left(\frac{1-3\sin^2\alpha'}{2}\right)$$

each of the base panels having a short diagonal and a long diagonal and further having a shape-holding structural frame, useful for assembly, and a reinforcing bar having free ends and extending the full length of the short diagonal thereof to allow said bar to absorb a compression load; the base panels each being mounted about one of the bearing points in a manner such that its short diagonal converges toward the one bearing point, the base panels thus all resting solely on the bearing points thereby transferring thereto all loads borne by the reinforcing bars, and the system further comprising:

tension elements having a Y or Δ shape joining together the free ends of the reinforcing bars of the three base panels arranged about each bearing point for reinforcing the assembly thereof, and a floor mounted over the base.

13. A system as claimed in claim 12, wherein the length L and L' and the angles $\alpha$and $\alpha'$ of inclination to the upper and lower edges of each wall panel are respectively equal so that the roof panels and the base panels have exactly the same shape and size.

14. A system according to claim 11, 12 or 13, further comprising at least one wall panel which is pre-formed with at least one opening therein.

15. A system as claimed in claim 12 or 13, wherein the roof panels that are coplanar are bolted together along the full length of their common edges.

16. A system as claimed in claim 12 or 13, wherein each bearing point is made up of a concrete pile set in the ground, said pile having an upper end of which project three armature rods that are folded so as to engage the reinforcing bars of the base panels which are assembled on the said bearing point.

17. A system as claimed in claim 12 or 13, wherein the base, the wall and the roof panels are secured to each other by bolting of the corners of their respective structural shape-holding frame.

18. A system as claimed in claim 12 or 13, wherein the floor is made up of:

at least one master beam passing over and resting on at least one of the bearing points, a plurality of joists straddling the Y-shaped tension elements whereby to absorb vibrations thereof, and a plurality of floor panels mounted on the said joists.

* * * * *